166-250 SR
FIP8011 OR 3,973,626

United States Patent [19]
Miles

[11] 3,973,626
[45] Aug. 10, 1976

[54] WELL COMPLETION IN PERMAFROST

[75] Inventor: Leon H. Miles, Plano, Tex.

[73] Assignee: Atlantic Richfield Company, Los Angeles, Calif.

[22] Filed: Sept. 24, 1975

[21] Appl. No.: 616,257

[52] U.S. Cl. ..... 166/250; 166/302; 166/DIG. 1

[51] Int. Cl.[2] ..... E21B 21/00; E21B 43/00; E21B 47/00

[58] Field of Search ..... 166/302, DIG. 1, 312, 166/250

[56] References Cited

UNITED STATES PATENTS

| | | | |
|---|---|---|---|
| 3,020,952 | 2/1962 | Sullivan | 166/250 X |
| 3,371,527 | 3/1968 | Moulin | 166/250 X |
| 3,729,986 | 5/1973 | Leonard | 166/250 X |
| 3,791,448 | 2/1974 | Schuh | 166/DIG. 1 |
| 3,876,004 | 4/1975 | Bell et al. | 166/DIG. 1 |

*Primary Examiner*—Ernest R. Purser
*Assistant Examiner*—George A. Suckfield
*Attorney, Agent, or Firm*—Roderick W. MacDonald

[57] ABSTRACT

A method for displacing a freezable liquid from a permafrost zone in a wellbore and replacing the displaced freezable liquid with an essentially nonfreezable liquid, wherein the nonfreezable liquid is introduced into the wellbore and displaced freezable liquid returns are recovered at the earth's surface, the nonfreezable liquid being of known water and solids content. The liquid returns are monitored for changes in water and solids content until a cumulative volume of freezable liquid has been recovered at the earth's surface which indicates displacement of the freezable liquid originally in the permafrost zone of the wellbbore to the desired extent.

4 Claims, 1 Drawing Figure

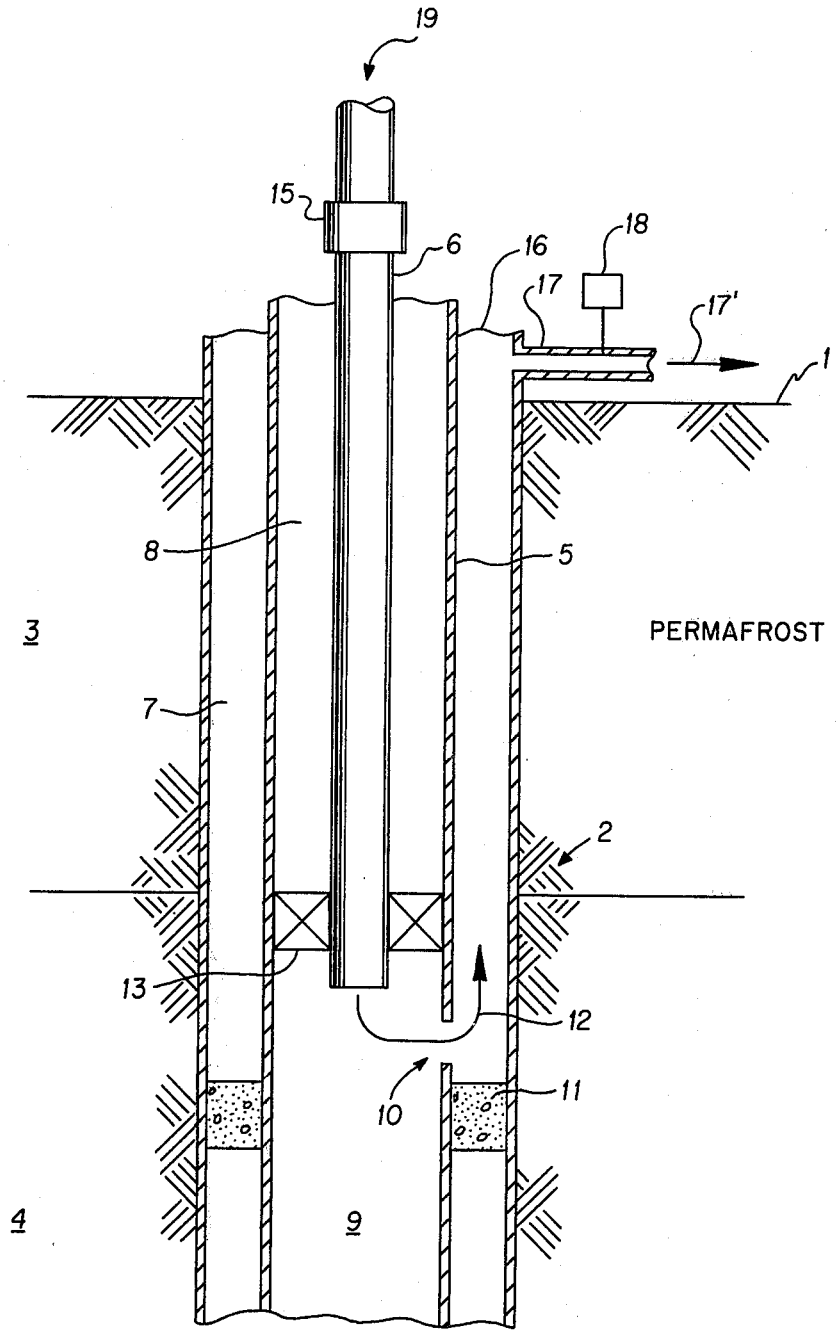
19
15
6
16
18
17
17'
1
8
5
3
PERMAFROST
7
2
13
12
10
11
4
9

WELL COMPLETION IN PERMAFROST

BACKGROUND OF THE INVENTION

Heretofore in drilling wells whose wellbores passed through a permafrost zone, water-based drilling fluids have often been employed. These drilling fluids contain a major amount of water and therefore are a freezable liquid.

It is undesirable to leave freezable liquids in the permafrost zone of a wellbore because, over the life of the well, the freezable liquid might become frozen.

Accordingly, it has been proposed to leave primarily only essentially nonfreezable liquids in the wellbore in the area of the permafrost zone. Procedures have been devised for displacing the freezable liquid from the wellbore and replacing same with an essentially nonfreezable liquid. In this invention, the term "essentially nonfreezable liquid" means that the liquid can contain some water, but generally will contain not more than about 30 volume percent water so that even should all this water, when properly distributed, freeze, there will be substantially no adverse affects to the well itself.

Initially, it was thought that a roughly one to one displacement process could be carried out, i.e., one volume of nonfreezable displacing roughly one volume of freezable liquid.

However, it has been found in actual practice that because of density differences between the freezable and nonfreezable liquids combined with the effect of gravity on the liquids as they pass downwardly in the wellbore, because of the difference in interfacial tensions between the freezable and nonfreezable liquids, and due to varying and often unknown rheological factors (for example, laminar flow, turbulent flow, and various gradations between these two types of flow in different parts of the wellbore at the same time) substantial amounts of the freezable liquid can be bypassed by the displacing nonfreezable liquid thereby failing to provide the desired result of essentially complete displacement of the freezable liquid from the permafrost zone of the wellbore.

Because the nonfreezable liquid is normally hydrocarbon based, it is highly desirable from an economic point of view as well as from an efficiency of operation point of view, to obtain essentially complete displacement of the freezable liquid using a minimum amount of nonfreezable liquid. Thus, the use of large excesses of nonfreezable displacement liquid in relation to the freezable liquid, i.e., using the nonfreezable liquid as a wash liquid, is not a viable alternative.

Further, in actual practice it has been found that in monitoring returns from a well to determine when essentially all of the freezable liquid has been recovered at the earth's surface, it is important from an accuracy point of view to calibrate the monitoring equipment on not only the water content but also the solids content of the liquid being monitored.

SUMMARY OF THE INVENTION

According to this invention, there is provided a method for essentially completely displacing a known volume of freezable liquid from a permafrost zone of a wellbore and replacing the freezable liquid with an essentially nonfreezable liquid wherein the nonfreezable liquid used is known in its composition not only as to water content but also as to solids content and the monitoring means employed to monitor the liquid returns from the wellbore during the displacement procedure is sensitive to changes in both water and solids and has been calibrated against the nonfreezable liquid when uncontaminated with additional water or solids and when so contaminated but in a known manner. The freezable liquid is then displaced with the nonfreezable liquid by introducing the nonfreezable liquid into the wellbore and recovering displaced liquid returns containing water at the earth's surface.

At least periodically during the displacing process changes in water and solids content of the returns are monitored and from this the total amount of freezable liquid returned to the earth's surface at any given time is determined. Also during the displacing process, the total amount of nonfreezable liquid introduced into the wellbore is measured. Based on the known volume of freezable liquid initially in place and, therefore, to be displaced from the wellbore, the total amount of nonfreezable liquid introduced into the wellbore, and the cumulative amount of water measured in the freezable liquid returns at the earth's surface, it is determined when essentially all of the freezable liquid has been displaced from the wellbore almost at the time that this occurs. This allows termination of the displacement process at the very first opportunity after essentially complete displacement has in fact taken place thereby minimizing the amount of nonfreezable liquid employed without sacrificing the desired result of essentially complete removal of the freezable liquid from the wellbore.

Normally, greater than one volume of nonfreezable liquid is employed in the displacement process in order to remove one volume of freezable liquid from the wellbore, but rather than using for all wells an arbitrarily excessive volume of nonfreezable liquid, e.g., twice the amount of freezable liquid to be displaced, by practicing the method of this invention the amount of nonfreezable liquid actually used is tailored to the specific requirements of the particular well under treatment including the specific characteristics and compositions of the freezable and nonfreezable liquids involved in that treatment. This is important because due to varying conditions in different wells and differences in compositions of the freezable and nonfreezable liquids from well to well, widely varying amounts of nonfreezable liquid are necessary to obtain essentially complete displacement of the freezable liquid in each well. However, by this invention each displacement method is tailored to that particular well and the composition of the freezable and nonfreezable liquids to be used in conjunction with that well since the liquid returns monitoring step of this invention is calibrated on the nonfreezable liquid, and that monitoring step is carried out based on the known volume of the freezable liquid to be displaced. The displacement method is also carried out only to the point where such monitoring indicates to a relative certainty that the desired amount of freezable liquid has been displaced from the wellbore without using excessive amounts of nonfreezable liquid.

DETAILED DESCRIPTION OF THE INVENTION

The drawing shows a cross section of a wellbore passing through a permafrost zone in which the process of this invention is carried out.

More specifically, the drawing shows the earth's surface 1 having a wellbore 2 passing therethrough. Wellbore 2 passes through permafrost zone 3 into unfrozen earth 4. Wellbore 2 extends for a finite distance into unfrozen earth 4 and after drilling is left essentially liquid-full of a water-based drilling fluid. Wellbore 2 has steel casing 5 extending the length thereof at least in the permafrost zone. Concentric with and interiorly thereof is steel tubing 6 which extends for the length of permafrost zone 3. Thus, there is provided in permafrost zone 3 of wellbore 2 an annulus 7 which is liquid-full of a freezable liquid. Annulus 8 as well as the lower remainder 9 of wellbore 2, i.e., below the lower end of tubing 6, is also liquid-full of freezable liquid. However, all freezable liquid below permafrost zone 3 and in unfrozen earth zone 4 is of no concern to this invention.

This invention can be applied to more than one annulus or other cavity in the permafrost zone of the wellbore, e.g., annulus 8, although the invention will be described herein, for sake of brevity, only with respect to annulus 7.

One or more apertures 10 are provided in casing 5 just below permafrost zone 3. Annular collar 11 composed of cement or the like is emplaced below aperture 10 so that non-freezable liquid entering annulus 7 by way of aperture 10 will flow upwards towards the earth's surface as shown by arrow 12 rather than downwards deeper into the wellbore. Packoff means 13 is emplaced in annulus 8 near the lower end of tubing 6 so that nonfreezable liquid exiting from the lower end of tubing 6 will pass through aperture 10 rather than upwards in annulus 8, remainder 9, being liquid-full, helping direct nonfreezable liquid from tubing 6 into aperture 10.

Tubing 6 is provided with a conventional cumulative flow meter 15 so that the total amount of nonfreezable liquid introduced into wellbore 2 can be measured during the displacement process. A conventional well head 16 with an exit conduit 17 is emplaced over annulus 7 so that liquid returns flowing in the direction of arrow 17′ can be directed to any desired location, and the water and solids content of these returns monitored by way of unit 18 for the purpose of determining the amount of water returned to the earth's surface from wellbore 2.

Before starting the process of this invention, the interior of tubing 6 and annulus 7 above aperture 10 are essentially liquid-full of, for example, freezable water-based drilling fluid. Thus, the volume of freezable liquid to be displaced, e.g., the volume of water-based drilling fluid left in the interior of tubing 6 and in annulus 7 above aperture 10, can be accurately determined. Accordingly, the volume of freezable liquid to be displaced is known.

The nonfreezable displacing liquid passes into the interior of tubing 6 as shown by arrow 19 for introduction into wellbore 2, and passes through cumulative flow meter 15 downwardly for the length of tubing 6 until it exits from the lower end thereof and is channeled through aperture 10 as shown by arrow 12. Passage of the nonfreezable liquid downwardly through tubing 6 and upwardly through annulus 7 generally displaces freezable liquid ahead of it, the freezable liquid being forced upwardly in annulus 7 until it returns to the earth's surface by way of conduit 17.

At least periodically; i.e., at spaced apart points of time; or, if desired, during the entire displacing process, the water and solids content of the liquid returns passing through conduit 17 is monitored by unit 18. During the same displacing process, the total amount of nonfreezable liquid introduced into the wellbore is determined and retained by unit 15. Thus, when it is known by way of unit 15 that a volume of nonfreezable liquid has been introduced into wellbore 2 which is as great as or greater than the known volume of freezable liquid initially present in the interior of tubing 6 and annulus 7, and when by way of unit 18 it is known that the amount of water actually returned to the earth's surface and recovered through conduit 17 is at least about 80 volume percent of the known volume of freezable liquid initially present in the wellbore, it is known to a reasonable certainty that essentially complete displacement of the freezable liquid from the permafrost zone of the wellbore has been completed and this is known to a relative certainty without using an amount of nonfreezable liquid in excess of that required to achieve the desired essentially complete displacement state. This minimizes the amount of nonfreezable liquid employed in the displacement process without in any way sacrificing the certainty that essentially complete displacement of freezable liquid has been achieved.

The monitoring of the changes in water and solids content of the liquid returns in conduit 17 can be achieved by any known apparatus which is sensitive to changes of both water and solids in the monitored liquid. One suitable apparatus is Halliburton Company's Net Oil Analyzer which consists of a metal probe mounted centrally in a pipe, both of which are wired to an electronic oscillator circuit. Depending on the composition and, hence, the dielectric constant, of the liquid in which the probe is immersed for monitoring, the probe and pipe form a variable capacitor, causing the oscillator to generate outputs of varying frequencies. By calibrating the output frequency against an uncontaminated sample of the nonfreezable liquid and samples of nonfreezable liquid of known water and solids contamination, this device can be used to monitor liquid returns in the method of this invention and from such monitoring the amount of water actually removed from the wellbore by way of such liquid returns determined. The Net Oil Analyzer is well-known in the art and it and its operation is more fully and completely disclosed in Halliburton Data Sheet SP-11041, dated September, 1968.

This invention is particularly suitable for a process wherein the water-based drilling fluid left in the wellbore is first washed from the wellbore using excessive amounts of a relatively inexpensive wash liquid such as common water. This is so because, by the method of this invention, liquid initially present in the wellbore is displaced to a reasonable certainty. Thus, the wellbore can be full of primarily only water and the results of this invention still reliably achieved.

EXAMPLE

Wellbore 2 was drilled using a drilling fluid composed of a major amount of water and sufficient amounts of bentonite thickening agent and barite weighting agent and to give the drilling fluid a weight of 10.8 pounds per gallon and a yield point of 9 pounds per 100 square feet. The interior of the wellbore, including 5 inch diameter tubing 6 and annulus 7 between 13⅜ inches diameter outer casing and 9⅝ inches diameter inner casing was filled with the drilling fluid, apertures 10 being 2,446 feet below the earth's surface.

The drilling fluid in tubing 6 and annulus 7 comprised a total volume of 183 barrels (42 U.S. gallons/barrel) and was washed to the earth's surface using a total of 503 barrels of ordinary water without additives. The wash water was introduced by way of pipe 6, as shown by arrow 19, at a rate of 10 to 11 barrels per minute and passed through apertures 10 and upward in annulus 7 to the earth's surface washing drilling fluid out as it moved through the wellbore. Wash water was introduced until clear wash water returns were made at the earth's surface thereby indicating essentially complete removal of drilling fluid.

A nonfreezable liquid composed essentially of diesel fuel containing 17 pounds/barrel of geltone solid weighting agent was employed to displace the wash water from tubing 6 and annulus 7. The Halliburton Net Oil Analyzer was calibrated against both uncontaminated diesel fuel nonfreezable liquid and such liquid containing known and differing amounts of water. After 179 barrels of diesel fuel were shown by flow meter 15 to have been pumped into tubing 6, the Net Oil Analyzer output indicated a substantial reduction in water content and, therefore, breakthrough of the nonfreezable liquid to the earth's surface. After a total of 320 barrels (including the 179 barrels to breakthrough) of diesel fuel liquid were pumped into tubing 6 at a rate of 3 barrels per minute, the Net Oil Analyzer output indicated no water in the returns and, therefore, complete displacement of water from the wellbore. At this time the displacement process was terminated. The water contamination of the liquid returns at the end of the displacement job was zero and the cumulative amount of water displaced, as determined from Net Oil Analyzer readings, indicated the volume of water recovered essentially equalled the initial volume of drilling fluid to be displaced, i.e., 183 barrels. Thus, essentially all the wash water was removed from inside tubing 6 and annulus 7, and was replaced by the nonfreezable diesel fuel-based liquid. This was accomplished using only 320 barrels of diesel fuel liquid whereas if the diesel fuel had been used as a wash liquid a volume closer to 503 barrels of diesel fuel would have been used as was done with the water wash. Accordingly, essentially complete displacement was reliably achieved using a smaller volume of the more expensive nonfreezable liquid than if the nonfreezable liquid was used as a wash liquid.

Reasonable variations and modifications are possible within the scope of this disclosure without departing from the spirit and scope of this invention.

The embodiments of the invention in which an exclusive property or privilege is claimed are defined as follows:

1. A method for displacing a known volume of freezable liquid from a permafrost zone of a wellbore and replacing said freezable liquid with an essentially nonfreezable liquid under the conditions present in said permafrost zone of said wellbore, comprising providing an essentially nonfreezable liquid of known water content and solids content, providing monitoring means which is sensitive to changes in both water and solids and which has been calibrated against said nonfreezable liquid when uncontaminated with additional water or solids and when contaminated in a known manner, displacing freezable liquid with said nonfreezable liquid by introducing said nonfreezable liquid into said wellbore and recovering freezable liquid returns at the earth's surface, at least periodically during said displacing process monitoring changes in water and solids content of said liquid returns and determining therefrom the total amount of water returned at any given time, during said displacing process measuring the volume of nonfreezable liquid introduced into said wellbore, and terminating said displacement step when the total volume of freezable liquid in said returns together with the total volume of nonfreezable liquid introduced into said wellbore indicates displacement to the desired extent of the freezable liquid initially present in said wellbore.

2. The method of claim 1 wherein said monitoring of changes in water and solids content of said liquid returns is accomplished by detecting changes in frequency output due to changes in the dielectric constant of the monitored liquid.

3. The method of claim 1 wherein said freezable liquid is essentially only water and said nonfreezable liquid is hydrocarbon based and contains not more than 30 volume percent water.

4. The method of claim 1 wherein said displacement step is terminated when the total amount of water recovered by way of said liquid returns reaches at least about 80 volume percent of said known volume of freezable liquid initially present in the permafrost zone of said wellbore.

* * * * *